US011918875B2

(12) United States Patent
Bardakh

(10) Patent No.: US 11,918,875 B2
(45) Date of Patent: Mar. 5, 2024

(54) STRUCTURES FOR SPORT FENCING

(71) Applicant: FSCFP Corporation, New York, NY (US)

(72) Inventor: Konstantin Bardakh, New York, NY (US)

(73) Assignee: FSCFP CORPORATION, New York, NY (US)

( * ) Notice: Subject to any disclaimer, the term of this patent is extended or adjusted under 35 U.S.C. 154(b) by 545 days.

(21) Appl. No.: 17/143,348

(22) Filed: Jan. 7, 2021

(65) Prior Publication Data

US 2022/0212079 A1 Jul. 7, 2022

(51) Int. Cl.

| | |
|---|---|
| ***A63B 69/02*** | (2006.01) |
| ***A63B 6/00*** | (2006.01) |
| ***A63B 71/06*** | (2006.01) |

(52) U.S. Cl.

CPC ..... *A63B 69/02* (2013.01); *A63B 6/00* (2013.01); *A63B 71/0669* (2013.01); *A63B 2069/025* (2013.01); *A63B 2071/0694* (2013.01); *A63B 2225/74* (2020.08)

(58) Field of Classification Search

CPC ..... A63B 69/02; A63B 6/00; A63B 71/0669; A63B 2069/025; A63B 2071/0694; A63B 2225/74; A63B 2209/00

USPC ..... 463/47.1

See application file for complete search history.

(56) References Cited

U.S. PATENT DOCUMENTS

| | | | | |
|---|---|---|---|---|
| 9,550,103 | B1 | 1/2017 | Zivkovik | |
| 10,518,154 | B2 | 12/2019 | Bennett et al. | |
| 2012/0021014 | A1 | 1/2012 | Chantalat | |
| 2015/0059276 | A1* | 3/2015 | Valentine | E04F 15/225 52/403.1 |
| 2016/0230401 | A1 | 8/2016 | Bennett | |

FOREIGN PATENT DOCUMENTS

| | | |
|---|---|---|
| CN | 209734915 U | 6/2019 |
| CN | 111590972 | 8/2020 |
| DE | 2127371 | 12/1971 |
| WO | 2013/139316 | 9/2013 |

OTHER PUBLICATIONS

Written translation of German patent application DE2127371A1.*
International Search Report and Written Opinion issued in PCT Application No. PCT/US2022/011613, dated Mar. 21, 2022.

* cited by examiner

*Primary Examiner* — Michael C Grant
(74) *Attorney, Agent, or Firm* — Hogan Lovells US LLP

(57) ABSTRACT

Systems and methods for structures used in sport fencing are disclosed. In at least one embodiment, individual structure blocks, of one or more structure blocks to be associated together, have an upper layer, a shock absorption layer, and a cell-support layer; and a conductive feature of an upper layer connected with other conductive features enable fencing touches from weapons to the conductive feature results in electrical grounding or an electrical transmission through the two or more structure blocks and to a monitor device.

20 Claims, 7 Drawing Sheets

STRUCTURES FOR SPORT FENCING

FIELD

At least one embodiment pertains to structures sport fencing. In at least one embodiment, structure blocks that individually have all layers required to enable fencing bouts in a lightweight and sturdy build can be associated together to form a structure to support fencers thereby promoting mobility in the sport.

BACKGROUND

Portability of sport fencing structures include structures discussed in U.S. Pat. No. 10,518,154. A sport fencing structure may be portable because of adaptability of at least some components to be assembled and disassembled at a venue supporting sport fencing. A sport fencing structure may include ribs or stringers that may be first set into or on a floor. Floor panels are fixed to the ribs or stringers and an electrically conductive fencing strip may be applied thereon. Perimeter areas may be arranged outside or adjacent to an electrically conductive fencing strip. Perimeter areas may enable conduit features for passing wiring associated with an electrically conductive fencing strip. Support features may be mounted over floor panels and under an electrically conductive fencing strip for resilient support, such as to minimize forces associated with reactive impact forces asserted by a fencer to a surface. Impact forces include forces from fencers' lunges, jumps, fleches, or related sport fencing aspects.

DETAILED DESCRIPTION

Figure 1:
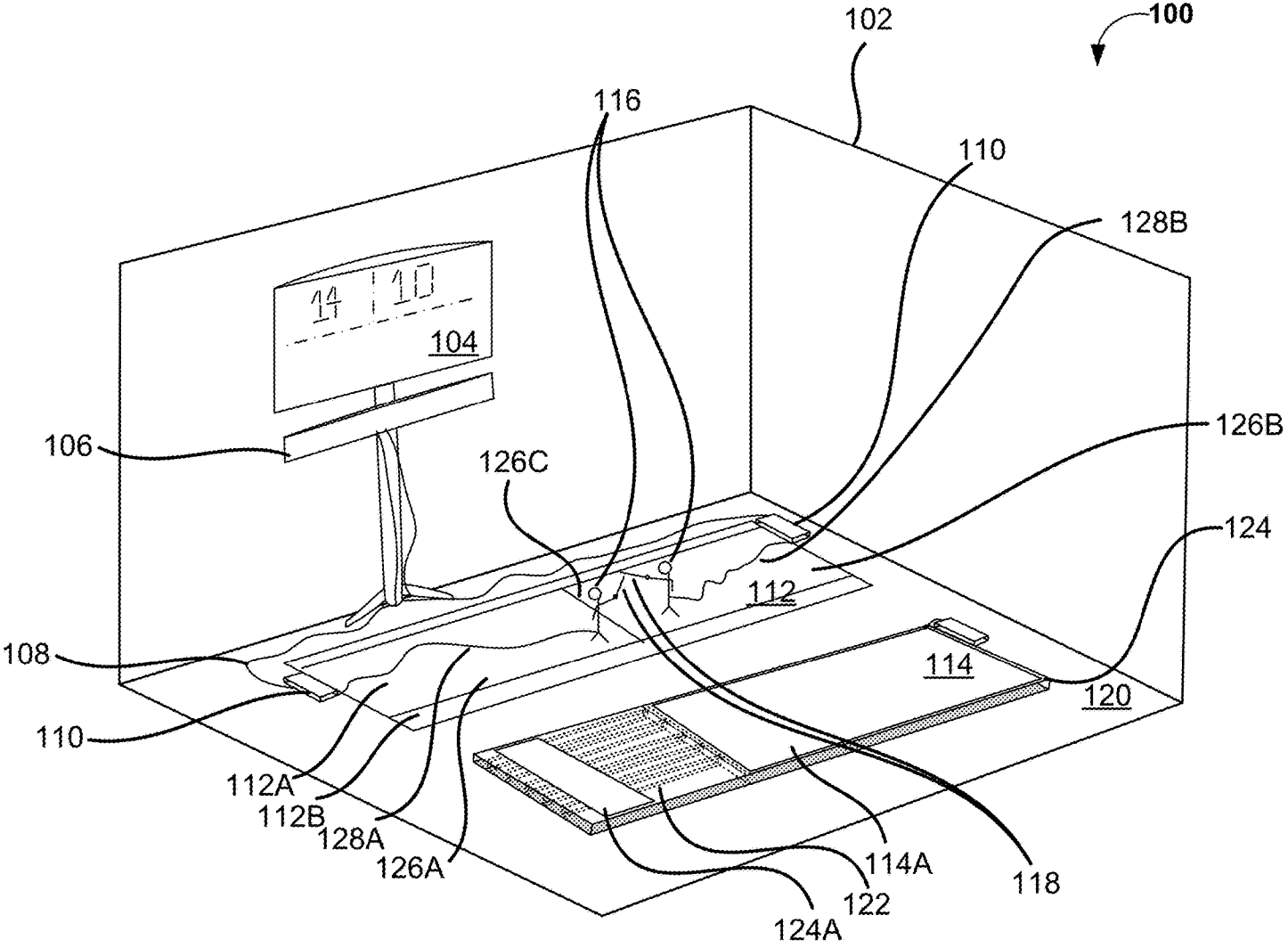
FIG. 1 illustrates an exemplary sport fencing structures subject to improvements described in at least one embodiment.

In at least one embodiment, an exemplary venue 100 can be utilized as illustrated in FIG. 1, which has exemplary sport fencing structures subject to improvements described herein. In at least one embodiment, numerous specific details are set forth to provide a thorough understanding, but concepts herein may be practiced without one or more of these specific details.

In at least one embodiment, sport fencing structure include one or more structure blocks associated together. In at least one embodiment, an individual structure block includes an upper layer, a shock absorption layer, and a cell-support layer. In at least one embodiment, a cell-support layer may have honeycomb cells or corrugated cells therein. In at least one embodiment, an upper layer includes a conductive feature and a friction feature. In at least one embodiment, an upper layer may be formed of extruded aluminum with elevated ridges to enable a friction feature relative to equipment worn on a fencer's foot. In at least one embodiment, a shock absorption layer includes rubber discs that may be located throughout each individual structure block. In at least one embodiment, rubber, plastic, metal discs may be used to provide shock absorption protection for an athlete's body; and in particular, back, hips, joints, legs, and other human aspects, from shocks of landing on a sport fencing structure during a fencing bout.

In at least one embodiment, a cell-support layer provides rigidity in a lightweight construction. In at least one embodiment, aluminum, plastic, or other lightweight composite material may be used for a cell-support layer. In at least one embodiment, a material of a cell-support layer that has durability to support weight and action of a fencing bout may be used. In at least one embodiment, a cell-support layer occupies substantial volume of an individual structure block. In at least one embodiment, as a cell-support layer occupies substantial volume of an individual structure block and as a cell-support layer incorporates lightweight material and incorporates spacing therein, it promotes mobility and portability of a sport fencing structure. In at least one embodiment, an individual sport fencing structure is light in weight for ease of transportation, for ease of assembly and for ease of disassembly.

In at least one embodiment, an underlayer may be provided after forming from aluminum, plastic, or other lightweight material that may be a similar material as a cell-support layer. In at least one embodiment, an underlayer is a bottom part of a "sandwich" to an upper layer and retains a shock absorption layer and a cell-support layer as part of an individual structure block to be associated with other similar structure blocks to form a structure for supporting sport fencing bouts.

In at least one embodiment, floor cords or wires may be provided to run from reels located at both ends of an individual structure block. In at least one embodiment, floor cords or wires may be replaced by wireless transmitters and receivers. In at least one embodiment, an individual structure block has four sides and all four sides may have individual reels. In at least one embodiment, these reels may have wiring or cord to associated with fencing equipment for transmission of touch or no-touch information by a variety of methods including change in potential and change in resistance from points associated with fencing equipment and with a fencing strip. In at least one embodiment, an individual structure block may be oriented in any direction with other similar structure blocks. In at least one embodiment, an individual structure block is symmetrical in its dimensions, such as forming a square; but may also be asymmetrical, such as forming a rectangle. In at least one embodiment, asymmetrical individual structure blocks enable a wider structure when put together in one dimension, as an alternative to a narrower structure when put together in a second dimension.

In at least one embodiment, an upper layer, when coupled to other upper layers, form a fencing strip. In at least one embodiment, a fencing strip may be at a center of associated upper layers. In at least one embodiment, electrical coupling may be provided from a fencing strip to a monitor device, including a scoring machine. In at least one embodiment, electrical coupling relies on low voltage (such as 12V) direct current (DC) power that is at low risk of most hazards. In at least one embodiment, monitor devices may monitor a circuit for its status, such as being open, closed, of high or low resistance, or of voltage changes therein. In at least one embodiment, a status is an electrical change that is indicated in a monitor device. In at least one embodiment, electric coupling may refer to a physical connection enabled or may refer to an electrical transmission enabled, and must be understood in a context being discussed. In at least one embodiment, electrical coupling may be securely tucked along sides of individual structure blocks using protective clips. In at least one embodiment, a non-fencing border strip or a non-playing surface may be provided at each edge of an individual structure block to hide floor cords or wires. In at least one embodiment, a non-fencing border strip may be formed of a same or similar material as an upper layer and may include conductive and friction features so that there is no visible distinction in a fencing strip when upper layers are associated together. In at least one embodiment, a non-fencing border strip may be provided on one side of an individual structure block for a side that is not associated with another individual structure block. In at least one embodiment, individual structure blocks are provided with only playing surfaces. In at least one embodiment, electrical coupling enables transmission of communicative signals as well as power, as required.

In at least one embodiment, floor cords or wires may be connected only between each individual structure blocks. In at least one embodiment, signals associated with fencing touches may be transmitted through floor cords or wires. In at least one embodiment, signals associated with fencing touches may be transmitted through individual structure blocks, from a saber, epee, or foil weapon, to a floor, to a floor cord or wire, and till it reaches a monitor device, such as a scoring machine. In at least one embodiment, a scoring machine monitors signals and is adapted infer a score based in part on determined instructions coded into a scoring machine. In at least one embodiment, a score can be inferred by counting each touch. In at least one embodiment, a non-fencing border strip or a non-playing surface may be a plain surface without conductive or friction features. In at least one embodiment, a non-fencing border strip or a non-playing surface may be set up in a not-conductive section of a flooring adjacent to a structure for sport fencing. In at least one embodiment, an individual structure block may be formed having an upper layer that is only frictional but is non-conductive. In at least one embodiment, an upper layer may be formed for a non-fencing border strip having underlying cables, cords, or wires, or a for non-playing usage. In at least one embodiment, a non-competition usage enables an individual structure block to be added adjacent to a fencing strip to allow fencing judges and directors a benefit of at least shock absorption in a similar manner as provided for athletes. In at least one embodiment, structure blocks as described herein may be used for both, competition and non-competition purposes, including for training.

In at least one embodiment, an upper layer may have one or more of translucent plastic or glass impregnated with conductive threads or filaments. In at least one embodiment, a shock absorption layer is distributed throughout an individual structure block, but may also be located at specific areas of an individual structure block. In at least one embodiment, a cell-support layer may be formed of cells made from one or more of plastic, foam, metal, or other similar material having properties similar to such materials and that are at least lightweight, but sturdy. In at least one embodiment, an underlayer may be formed of or include plastic, rubber, or other material having similar properties as these materials, and adapted for anti-shifting and adapted for floor protection, so that an underlying floor over which a sport fencing structure is formed may not be damaged from actions in a fencing bout.

In at least one embodiment, floor cords or wires run from reels located at ends of an individual structure blocks electrically couple an upper layer with other upper layers, in a serial manner, to form a fencing strip. In at least one embodiment, an electrical coupling from structure blocks terminates at a monitor device (including or associated with a scoring machine). In at least one embodiment, a monitor device may be embedded inside an individual structure block. In at least one embodiment, electrical coupling between floor cords or wires may be enabled by male-to-female connectors that are understood from body cords and fencing floor cords used in fencing bouts. In at least one embodiment, wires or cords associated with an upper layer may be embedded in an upper layer or may be passed beneath an upper layer and in channels or gaps provided between an upper layer and a shock absorbing layer.

In at least one embodiment, an individual structure block is each dimensioned at about 4 feet by 5 feet (or 1 meter by 1.5 meters). In at least one embodiment, an individual structure block can be associated together along a minor or major dimension. In at least one embodiment, an individual structure block may be therefore turned ninety degrees to change sizing of a fencing strip form from associated structure blocks. In at least one embodiment, a fencing strip can therefore be four feet (1 meter) wide from individual structure blocks connected together, or can be five feet (1.5 meters) wide when each individual structure block is rotated 90 degrees and associated together.

In at least one embodiment, aspects previously discussed including a friction feature and a conductive feature are maintained regardless of direction of individual structure blocks. In at least one embodiment, at least a friction feature an underlayment layer are adapted to maintain anti-slippage properties as mandated by rules for fencing athletes' safety administered by any international or domestic entity, such as a fencing sport governing body. In at least one embodiment, an upper layer may have or include a translucent or transparent features throughout or at least in a part of an upper layer. In at least one embodiment, translucency or transparency enables light to emanate, thereby indicating touches or other information during or associated with a fencing bout. In at least one embodiment, an entire half of a fencing strip may be caused to light up in a color, such as a red or green color, making it easy for spectators and others to determine who scored a touch during a fencing bout.

In at least one embodiment, translucency or transparency enables displaying, in an upper layer, fencers' names, pictures, and characteristics. In at least one embodiment, characteristics may include national flag, as per competition fencing regulations, and other related information. In at least one embodiment, advertisements, club affiliations, or name of competition may also be displayed. In at least one embodiment, a non-playing individual structure blocks is entirely of a non-playing surface (not having friction and/or conductive features) and may be added adjacent to, such around perimeter of, a fencing strip formed from individual structure blocks having conductive and friction features on an upper layer.

In at least one embodiment, non-playing individual structure blocks may be adapted to display graphics adjacent or outside a fencing strip. In at least one embodiment, non-playing individual structure blocks associated together form at least a 17 meter strip section to display graphic, including those associated with a competition and associated with layout of fencers positions at a start of a fencing bout. In at least one embodiment, individual structure blocks for a fencing or playing surface may be associated together to form at least a 17 meter strip of fencing surface. In at least one embodiment, when structure blocks are rotatable, they may be rotated and associated together to form a 14 meter strip of fencing surface.

In at least one embodiment, an exemplary venue 100 can be utilized as illustrated in FIG. 1, which has exemplary sport fencing structures subject to improvements described herein. In at least one embodiment, a venue 100 supports sport fencing structures 112, 114 on or under a floor 120. In at least one embodiment, when a sport fencing structure 112 is under a floor 120, it is at least partly under the floor so that a fencing strip 112A may be flush with a floor 120. In at least one embodiment, a perimeter strip 112B that is a non-fencing surface or a non-fencing border strip may be provided with one or more fencing structures 112, 114, and may be flush with a floor 120 in a similar manner for at least an associated sport fencing structure 112.

In at least one embodiment, sport fencing structure 114 may have supporting ribs or stringers 122 over which stable surface 124 having floor panels 124A is provided. In at least one embodiment, floor panels 124A are attached to ribs or stringers 122 to provide a stable surface 124. In at least one embodiment, a fencing piste or strip 114A (like fencing strip 112A) may be provided over a stable surface 124. In at least one embodiment, a fencing strip 114A; 112A is a conductive material, such as formed of or including one or more sheets of a metal mesh, a perforated metal material, a dimpled metal material, or laminated metal material.

In at least one embodiment, a fencing strip 112A; 114A may include multiple serially coupled fencing sub-piste or sub-strips 126A, B, which may be joined by a conductive strip at a junction 126C. In at least one embodiment, cords or wiring 108, 128A, 128B require detailed attention and time to be properly associate together and to ensure proper installation. In at least one embodiment, receiver devices 110 receive transmission from fencing surfaces 124, which it then communicates to a monitor device 106 and which may be interpreted for display on a display device 104 hung on a supporting feature, such as a wall or an edge 102.

In at least one embodiment, fencers 116 may use equipment 116, including weapons and jackets in a fencing bout. In at least one embodiment, weapons include sabers, foils, and épées. In at least one embodiment, a jacket may have determined areas for targeted touching by a weapon. In at least one embodiment, fencers 116 may be electrically coupled to a receiver device via cords or wiring 128A, 128B provided from bodysuits worn by fencers 116. In at least one embodiment, fencers 116 may be electrically coupled to a piste or strip 112A or their equipment may be electrically coupled to a piste or strip 112A. In at least one embodiment, a piste or strip 112A provides electrical grounding (also referred to as ground or grounding) for fencing equipment, including weapons or body suit of fencers. In at least one embodiment, electrical grounding is referred to as a condition of zero resistance in an electrical path. In at least one embodiment, when electrical grounding is not provided, a potential may exist in an electrical path, such as a wire or cord, and a non-zero or high resistance may exist in an electrical path.

In at least one embodiment, structure blocks address an issue in a sport fencing structure 112; 114 that may have limited portability because of extensive ribs or stringers 122 requiring installation, followed by floor panels 124A and one or more electrically conductive fencing strip(s) 114A applied thereon. In at least one embodiment, structure blocks address an issue of requiring perimeter areas that may additionally need to be arranged outside or adjacent to an electrically conductive fencing strip 112A; 114A. In at least one embodiment, structure blocks address issues of requirement for electric coupling for a fencing strips and cords and wire management. In at least one embodiment, structure blocks, with its conductive feature, enables electrical ground of higher potential in fencing equipment. In at least one embodiment, grounding may register as a touch or a no-touch depending on configuration for fencing equipment in a fencing bout.

Figure 2:
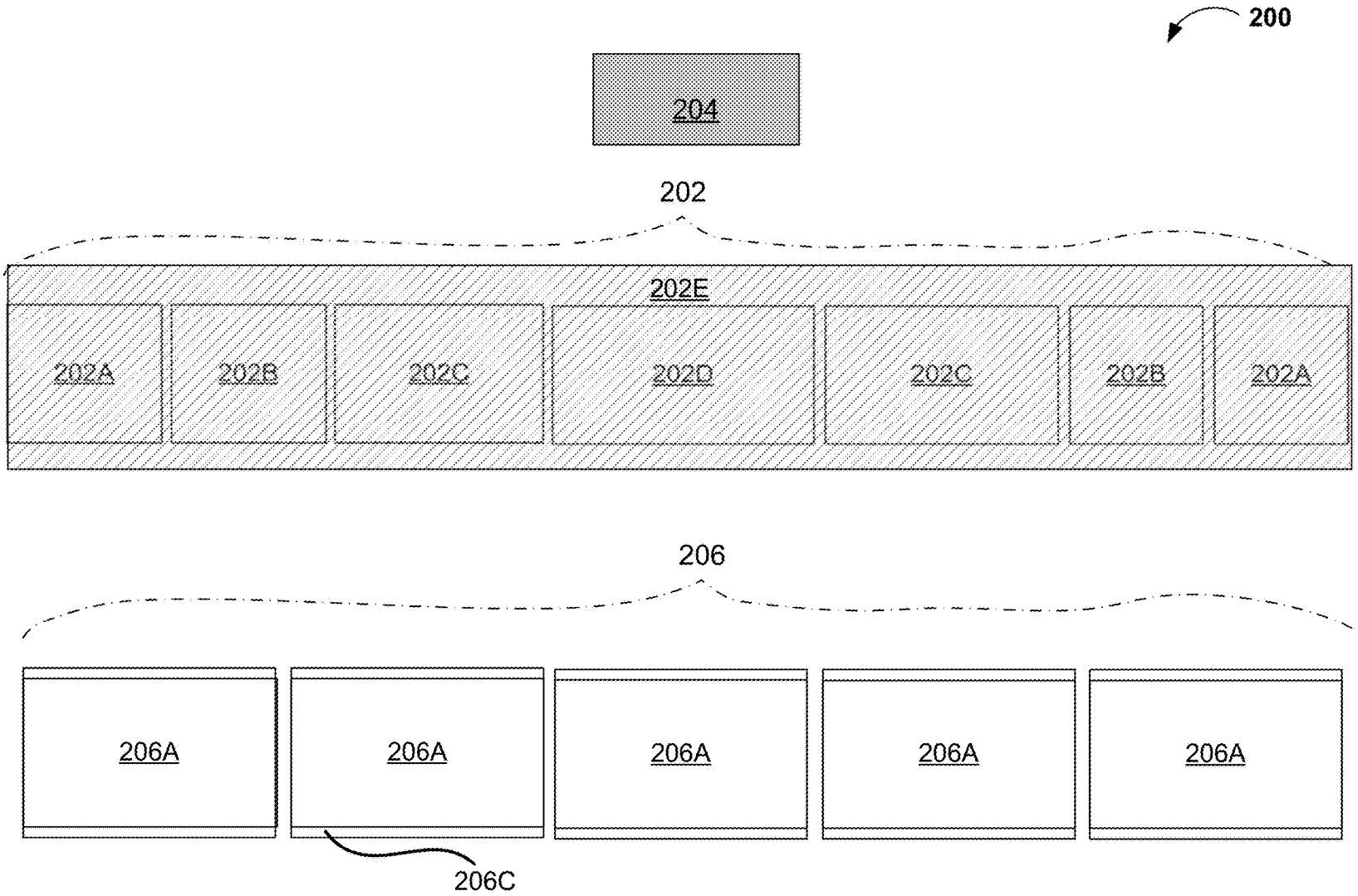
FIG. 2 illustrates modular arrangement subject to an improvement and a modular arrangement according to at least one embodiment for structures used in sport fencing.

In at least one embodiment, aspects 200 of a modular arrangement using floor panels 202 as illustrated in FIG. 2, benefits from a modular arrangement using structure blocks 206 according to at least one embodiment for structures used in sport fencing described herein. In at least one embodiment, modular arrangement using floor panels 202 may have stringers or ribs installed and may be installed in sections as illustrated. In at least one embodiment, a fencing strip or multiple fencing strips and/or other layers 202E may be then overlaid on floor panels 202A-D to suit different width of floor panel and along its entire length. In at least one embodiment, floor panels 202A-D are 1.5 meters to 2 meters wide, 3 meters or 4 meters wide. In at least one embodiment, provided floor panels 202A-D are all affixed to ribs of stringers. In at least one embodiment, a length of an installation or structure for fencing may be 14 meters or 17 meters.

In at least one embodiment, structure blocks 206A may be associated together to form a structure 206 for sport fencing that is an improvement over a modular arrangement using floor panels 202 requiring stringers or ribs, floor panels, and one or more fencing strips. In at least one embodiment, individual ones of structure blocks 206A, provided for association together, may be of same dimensions and have all layers required for a fencing structure, unlike floor panels 202A-D which do not have all layers referenced throughout herein and are of different dimensions. In at least one embodiment, provided structure blocks 206A may or may not include a non-fencing border strip 206C. In at least one embodiment, individual structure blocks 206A may be provided in a 4 by 5 meter dimension, and are rotatable when provided without a non-fencing border strip 206C. In at least one embodiment, not all of a formed structure 206 is used for a fencing strip. In at least one embodiment, this enables structure blocks 206A to be interchangeably used or rotated and used at a different width. In at least one embodiment, a structure block 206A may include one or more non-fencing border strip 206C (such as on opposing sides and no non-fencing border strip on other opposing sides as illustrated). In at least one embodiment, a structure block 206A may be associated with other structure blocks in a first or a second direction relative to a dimension of a structure block. In at least one embodiment, a structure block 206A may be associated with other structure blocks along their widths. In at least one embodiment, a structure block 206A may be associated with other structure blocks along their lengths.

In at least one embodiment, structure blocks 206A may have a same width and length or different width and length. In at least one embodiment, a non-fencing border strip of a structure block 206A may be a non-fencing border strip adjacent an edge of a structure block that does not interfere with a structure block's ability to sit flush or almost flush with another structure block. In at least one embodiment, structure blocks 206A, once associated together both physically and electrically, are further electrically coupled to monitor device 204. In at least one embodiment, touches from weapons to a conductive feature results in electrical grounding or an electrical transmission through two or more structure blocks and to a monitor device 204.

Figure 3:
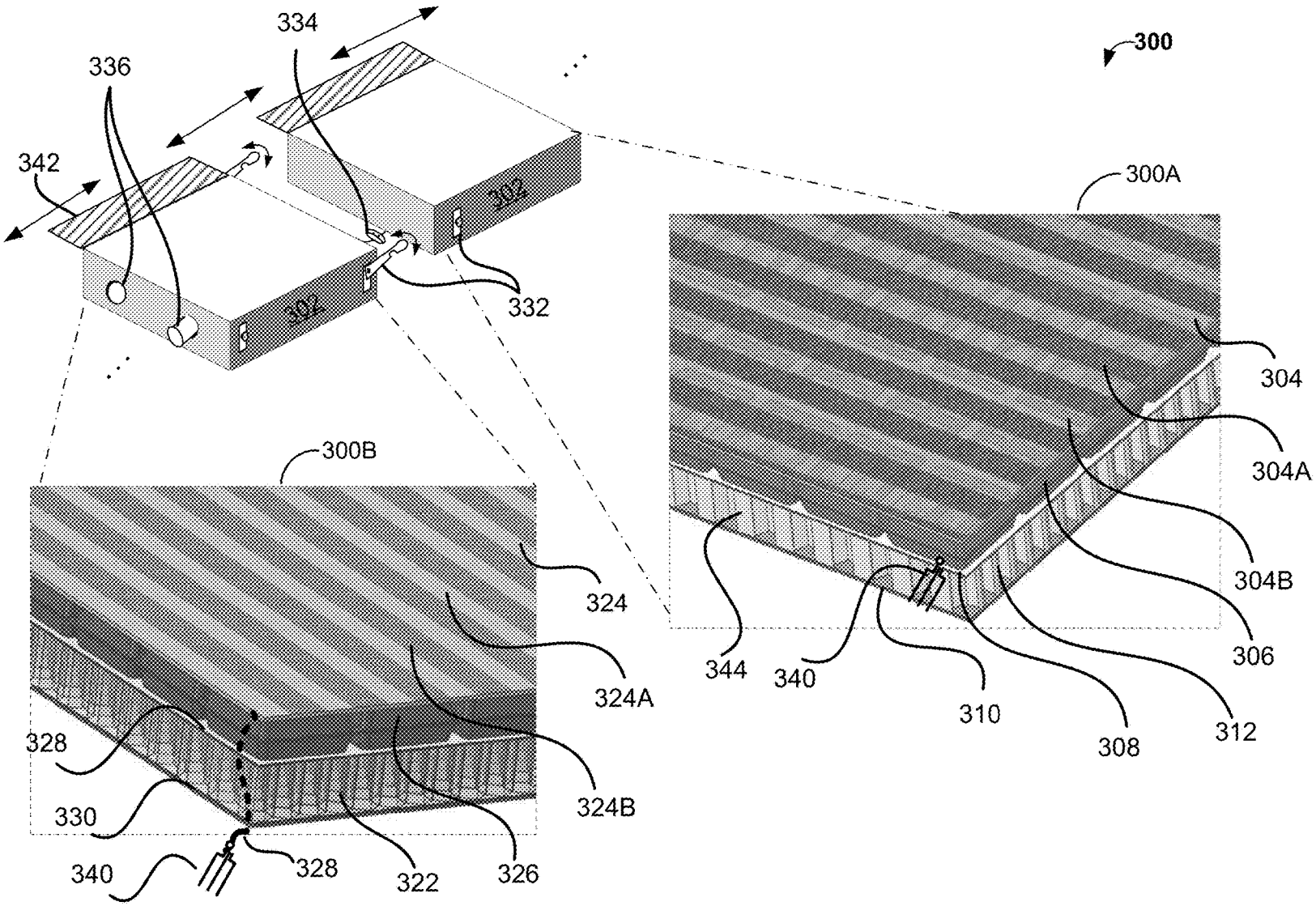
FIG. 3 illustrates various views of cross-sections and various layering aspects for structures used in sport fencing, according to at least one embodiment.

In at least one embodiment, cross-sections and various layering aspects 300 for structures used in sport fencing as illustrated in FIG. 3, may be used as described herein. In at least one embodiment, structure blocks 302 may be associated together to form a structure for sport fencing that is an improvement over a modular arrangement using floor panels requiring stringers or ribs, floor panels, and one or more fencing strips. In at least one embodiment, individual ones of structure blocks 302, provided for association together, may be of same dimensions or different dimensions, where different dimensions enable rotation and association to form fencing strips of at least two different dimensions from a group of structure blocks 302.

In at least one embodiment, a structure block 302 may include a non-fencing border strip 342. In at least one embodiment, a non-fencing border strip 342 may be incorporated within a structure block 302 so that there is no over-hang that is illustrated in FIG. 3. In at least one embodiment, a structure block 302 may be associated with other structure blocks in a first or a second direction relative to a dimension of a structure block and using one or more guides 336. In at least one embodiment, in lieu or together with any provided guides 336, corrugations of corrugated cells or hexagonal features of honeycomb cells in a cell-support layer may be used to mate or interlock with negative corrugations of another structure block for secure association of structure blocks. In at least one embodiment, latches 332 of an appropriate nature may be provided for physically securing an association of structure blocks 302. In at least one embodiment, electrical coupling may be provided by socket and plug coupling 334.

In at least one embodiment, a structure block 302 may be associated with other structure blocks along their widths. In at least one embodiment, a structure block 302 may be associated with other structure blocks along their lengths. In at least one embodiment, structure blocks 302 may have a same width and length or different width and length. In at least one embodiment, a non-fencing border strip 342 of a structure block 302 may be a non-playing surface at an edge of a structure block 302 and that sits flush with another non-fencing border strip of another structure block. In at least one embodiment, electrical coupling may be enabled by a non-fencing border strip 342 that may be constructed of an underlying conductive material, such as a material used and described with respect to upper layer 304; 324. In at least one embodiment, metal form of a non-fencing border strip may enable a conductive upper layer of each structure block 302 to be in electrical coupling with another upper layer of another structure block 302. In at least one embodiment, this may be while also maintaining a non-playing surface above a non-fencing border strip, so that observers may walk over such areas without interfering with a fencing bout. In at least one embodiment, therefore, a non-fencing border strip is a wide strip supporting weight for non-fencing purposes.

In at least one embodiment, structure blocks 302, once associated together both physically and electrically, are further electrically coupled to monitor device. In at least one embodiment, an individual structure block 302 of one or more structure blocks includes an upper layer 304; 324, a shock absorption layer 306; 326, a cell-support layer 312; 322, and an underlayer 310; 330. In at least one embodiment, two different types of structure blocks 300A, 300B are illustrated. In at least one embodiment, both types of structure blocks may be interchangeable and interchangeably used. In at least one embodiment, an upper layer 304; 324 has a conductive feature 324A and a friction feature 324B. In at least one embodiment, a conductive feature and a friction feature are provided via an integrated and singular aspect of an upper layer. In at least one embodiment, a metal sheet or metal embedded sheet may be used, where a metal sheet supports a conductive feature by its physical property and supports a friction feature by raised grooves formed thereon. In at least one embodiment, a metal embedded sheet supports a conductive feature along an embedded metal strip and supports a friction feature by formations, such as a raised grooves on its general surface.

In at least one embodiment, a conductive feature of an upper layer may be connected with other conductive features of other upper layers when structure blocks are associated together. In at least one embodiment, conductive feature are provided so that grounding may be offered to complete circuits indicative of a touch or a no-touch with respect to fencing touches from fencers electrically coupled to a receiver device and a monitor device on one side and from their weapons that may electrically couple to individual structure blocks. In at least one embodiment, a weapon contacting an individual structure block may ground the weapon by a circuit from power transmitted from or through the weapon, through conductive features of upper layers of two or more structure blocks, and to a monitor device. In at least one embodiment, a cord or wire may be provided from a fencer's equipment or clothes (including shoes) to a conductive feature. In at least one embodiment, a fencer's equipment or clothes may form a conductive path to a conductive feature.

In at least one embodiment, electrical couplers may be provided between fencers' equipment and a receiver device and/or a monitor device. In at least one embodiment, conductive feature of individual structures are electrically coupled via intervening cords or wires. In at least one embodiment, electrical couplers 340; 334 may be provided via electrical coupling lines 328 to electrically couple structure blocks 302. In at least one embodiment, electrical coupling lines 328 are provided from an upper layer through a channel or other provision to ensure that it is free from physical damage during association of structure blocks 302. In at least one embodiment, electrical coupling an electrical coupler 340; 334 is associated with a spool having electrical coupling lines 328. In at least one embodiment, a spool having electrical coupling lines 328 is spring-loaded to retracts an electrical coupling line upon disassociation of structure blocks 302.

In at least one embodiment, rubber features are associated together to form a shock absorption layer 306; 326. In at least one embodiment, elevated ridges 304B; 324B form a friction feature and conductive material 304A; 324A forms a conductive feature. In at least one embodiment, elevated ridges 304B; 324B may be formed on or integrated with a conductive material 304A; 324B so that a singular or integrated upper layer has both friction and conductive features. In at least one embodiment, reels or a wire storage having conductive wire (also referred to as electrical coupling lines 328) may be located on one or more ends of each structure block 302. In at least one embodiment, a conductive wire 328 may be electrically coupled to provide conduction between a conductive feature of one structure block 302 and other conductive features of other structure blocks 302.

In at least one embodiment, an anti-slipping material forms at least a portion of an underlayer 310; 330. In at least one embodiment, an anti-slipping material prevents movement of a structure formed of structure blocks 302. In at least one embodiment, an anti-slipping material provides protection to a floor under a structure formed of structure blocks 302. In at least one embodiment, an intermediate layer 308; 328 may be provided to retain cells of a cell-support layer 312; 322. In at least one embodiment, cells of a cell-support layer may be rigid hollow cells, such as honeycomb cells (322) or corrugated cells (312). In at least one embodiment, other cells having rigidity while devoid of solid features, such as by symmetrical cells having a hollow portion may form part of a cell-support layer 312; 322.

In at least one embodiment, translucent plastic impregnated with conductive threads or filaments forms at least a portion of a conductive feature 324A or to form an upper layer 324. In at least one embodiment, a translucent plastic having surface irregularities forms at least a portion of a friction feature 324B of an upper layer 324. In at least one embodiment, integrated friction and conductive features may be formed by a process, such as sandblasting of a conductive material. In at least one embodiment, surface irregularities in such a process may not be only elevations or ridges, but may be craters or indentations. In at least one embodiment, ridges, if formed, may be of any shape. In at least one embodiment, as structure blocks may be rotated, a friction feature must work in both or any direction of use.

In at least one embodiment, a translucent plastic having lights there under or within it forms an upper layer 304. In at least one embodiment, lights under an upper layer or within an upper layer allow illumination by one or more signals from a computing device that may be integrated or an separate and external from an upper layer. In at least one embodiment, a computing device (such as one or more of devices 504, 512, 514 in FIG. 5) may have at least one processor and memory having instructions to provide one or more signals through conductive threads or filaments between a computing device and lights under or within an upper layer 324. In at least one embodiment, a computing device (such as devices 504, 512, 514 in FIG. 5) may be a fixed or a mobile computing device or a wireless device that may be coupled to lights (wired or wireless), under or within an upper layer 324, to cause a display by instructions provided to lights there under or there within.

In at least one embodiment, an epee equipment may use cords having two sets of three-prongs plugs, with each prong connected by a cord or grouped wires within a cord. In at least one embodiment, one set of plugs is for electrical coupling between a fencer's weapon and a reel, which in turn is coupled to a conductive feature of an upper layer. In at least one embodiment, foils and sabers also have similar cords, but have two differently-sized coupling prongs. In at least one embodiment, a twist-lock bayonet connector may be provided. In at least one embodiment, a twist-lock bayonet connector is provided for electrical coupling on a foil or saber side and an additional cord or wire connects to a fencer's clothing, such as a jacket or lame. In at least one embodiment, targeted touches for foil and saber equipment may be determined using a wired connection associated with a determined area of a fencer's clothing or equipment.

In at least one embodiment, there may be three wires associated with a fencer's equipment including a wire from a jacket or lame, a wire from a weapon, and a ground wire. In at least one embodiment, a touch may be determined as an electrical coupling between a wire for a jacket and a wire for a weapon. In at least one embodiment, as a wire for a jacket is associated with a target area, when an electrical coupling occurs between a jacket and a wire for a weapon, an implication is that a fencer's weapon overcame an opponent fencer's defenses to touch an opponent fencer's jacket at a target area. As such, in at least one embodiment, a closed or open circuit is between one fencer's weapon and an opposing fencer's jacket. In at least one embodiment, a closed or open circuit may be defined in terms of resistance between wires associated with a jacket and a weapon. In at least one embodiment, wireless indications of a touch may be enabled by a completed circuit, during a touch, of a jacket and a weapon, which is then transmitted by a wireless transmitter to a wireless receiver of a receiver device. In at least one embodiment, a default condition of a circuit between a jacket and a weapon is an open circuit. In at least one embodiment, a default condition between a jacket and a weapon for a touch is a closed circuit.

In at least one embodiment, each weapon has a specific area for a closed or open circuit with a jacket of an opposing fencer. In at least one embodiment, each weapon has a ground line that is distinct from a specific area for a closed or open circuit with a jacket. In at least one embodiment, a ground line may be connected to a body of a weapon, while a closed or open circuit line may be connected to a tip of a weapon, which may represent a specific area for touching to a target or determined area of an opposing fencer's jacket.

In at least one embodiment, a circuit (either opened or closed) is provided from a first fencer's weapon to a conductive fencing strip 304; 324, on to one or more receiver devices, and to a monitor device. In at least one embodiment, a monitor device monitors for closed and open circuits between one or more receiver devices. In at least one embodiment, a monitor device may be adapted to work with multiple receiver devices, where each receiver device pairs between a fencing strip having one fencing bout to a monitor device. In at least one embodiment, then, each receiver device is a unique device.

In at least one embodiment, for a foil type of weapon, a cord or wire may be connected to a first fencer's jacket (non-grounded) and a second cord or wire may be connected to a tip of a second fencer's weapon. In at least one embodiment, a second cord or wire connected to a tip of a foil weapon may be connected to a ground line so that default electrical coupling for a tip of a foil weapon is to ground. In at least one embodiment, pressing a tip of a foil weapon against a jacket (at one or more determined or target areas) may cause a closed circuit to ground for a non-grounded cord or wire. In at least one embodiment, a closed circuit to ground may be a registered touch. In at least one embodiment, a closed circuit to ground may be enabled without wires by a 12V DC battery on a jacket that is grounded by a tip of a fencer's weapon, and which causes grounding information to be wireless passed to a receiver device. In at least one embodiment, when a tip of a foil weapon touches an opposing weapon or touches a fencing strip (which may be grounded), then no-touch is registered as a fencer's weapon is already grounded internally. In at least one embodiment, therefore, an open circuit (no grounding) represents high or infinite resistance and registered no-touches; while a closed circuit (grounding) represents low or zero resistance and a registered touch. In at least one embodiment, when a foil weapon's tip is otherwise non-contacting with any surface (or contacts surfaces that are not grounded or not at a potential, such as an opponent's target area of a jacket), then no-touch or an improper touch (not on target) may be the case.

In at least one embodiment, for a fencing bout with epee weapons, cords or wires are provided to tips of each weapon without regard to a jacket. In at least one embodiment, then, a fencing bout using epee weapons makes the entire person a target, including arms, legs, torso, and mask. In at least one embodiment, a tip of an epee weapon being depressed closes a circuit between two separate cords or wires. In at least one embodiment, a closed circuit between two cords or wires may be registered as a touch. In at least one embodiment, a fencing bout with épée weapons therefore leaves the entire body of an opponent as a target or determined area for touches. In at least one embodiment, a fencing strip may be grounded. In at least one embodiment, when a depression of a tip of an epee weapon occurs against a fencing strip, then any potential from either one or two separate cords or wires is grounded. In at least one embodiment, grounding of an epee weapon results in a no-touch result.

In at least one embodiment, for a sabre weapon, a wire or cord is electrically coupled to a jacket or lame. In at least one embodiment, for a sabre weapon one or more wires or cords may be electrically coupled to a body of a sabre weapon. In at least one embodiment, any contact between a sabre weapon and a jacket or lame may be registered as a valid touch because of closing of a circuit between a sabre weapon and a jacket or lame. In at least one embodiment, a jacket or lame, a mask, and a glove may have a determined or target area for touches. In at least one embodiment, grounding may not be required in a fencing bout with sabre weapons. In at least one embodiment, any touch between a sabre weapon and a fencing strip may result in no action. In at least one embodiment, if a fencing strip is grounded in a fencing bout involving sabre weapons, then a sabre weapon may be grounded, but this has no effect on registration of a touch as a closed circuit requires contact with a jacket or lame, a mask, or a glove.

In at least one embodiment, an open circuit potential exists in each case using a foil, an épée, or a sabre. In at least one embodiment, a close circuit potential may exist during a touch, which may be transmitted to a receiver device for inference by a monitor device. In at least one embodiment, a grounding to a fencing strip may be passed through a conductive feature across two or more structure blocks to a receiver device and may be inferred by a monitor device. In at least one embodiment, a grounding may be a touch, a no-touch, or may not have any effect on actions in a fencing bout. In at least one embodiment, safety switches may be provided (such as built into a receiver device or a monitor device) to be reset after a grounding has occurred. In at least one embodiment, as the voltage of operation is a low voltage, such as a 12V D.C., and so there can be no "high current" or other hazard situations. In at least one embodiment, a potential used in wires or cords may be just sufficient to register touches or no-touches, but does not harm or has safety features to allow shut-off in the event of grounding or high current draws.

Figure 5:
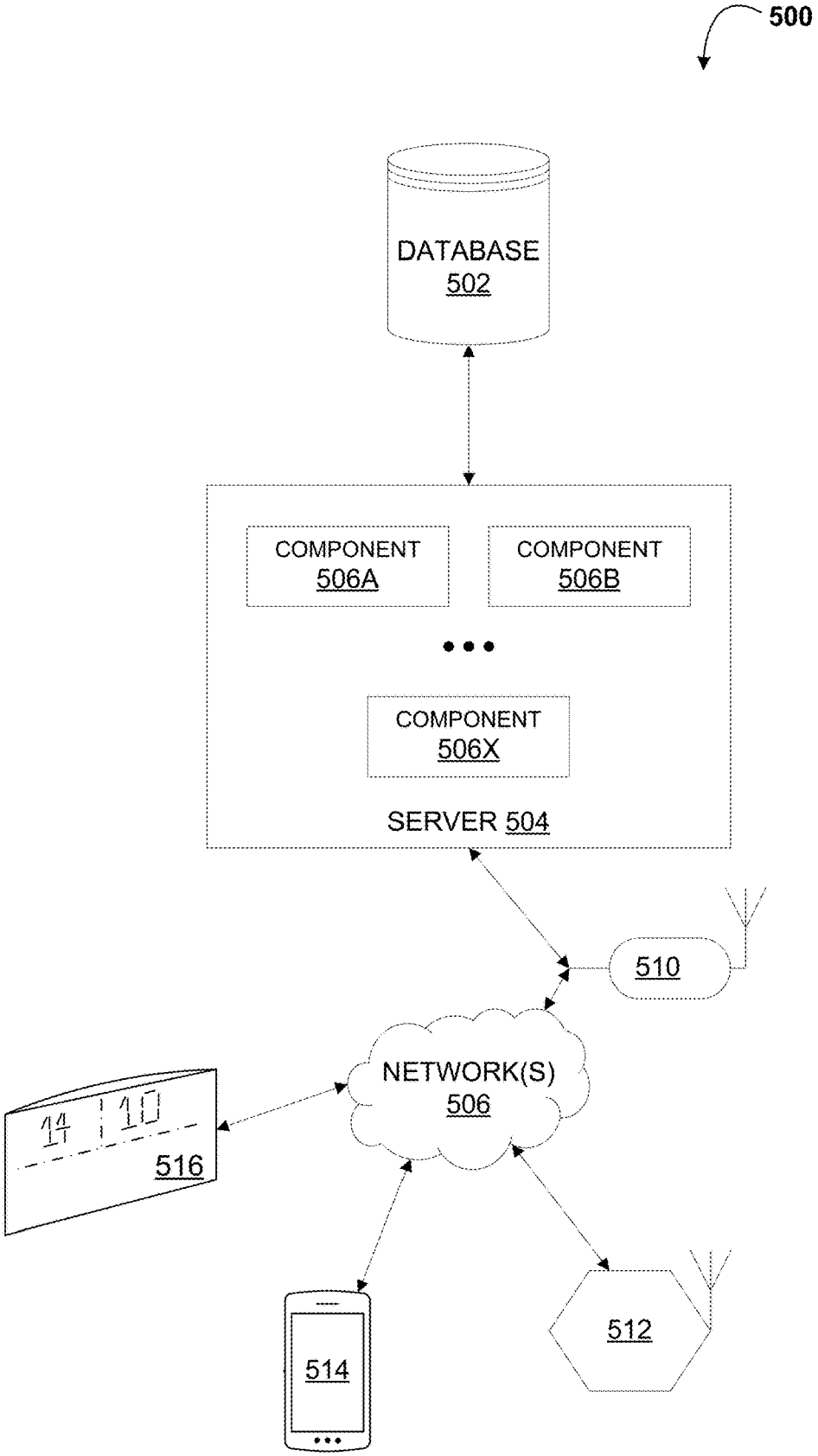
FIG. 5 illustrates computer and network aspects for structures used in sport fencing, according to at least one embodiment.

In at least one embodiment, electrical values may be transformed to binary data and may be recorded, transmitted, or displayed according to instructions of a computing system working with a receiver device and/or a monitor device. In at least one embodiment, a score board may be used to display a human-readable version of binary data, which may also be provided to remote systems for sharing, social media, and news reporting. In at least one embodiment, computing system aspects of FIG. 5 are readily adapted for these purposes.

Figure 4A:
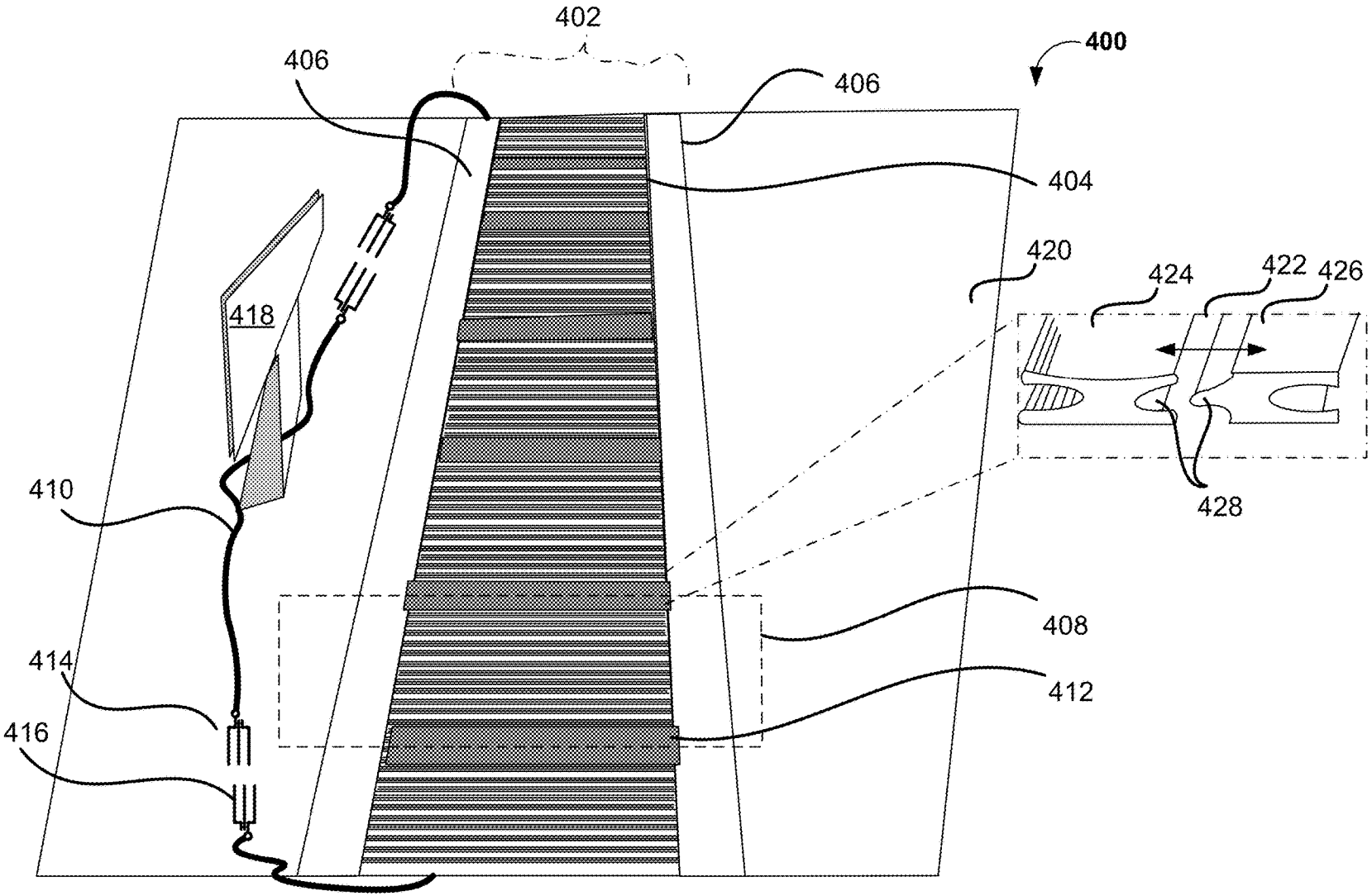
FIG. 4A illustrates structures for sport fencing, according to at least one embodiment.

In at least one embodiment, features 400 of a structure used in sport fencing as illustrated in FIG. 4A, may be used as described herein. In at least one embodiment, a structure 402 includes conductive fencing strip 404 and non-conductive (or conductive) perimeter areas 406. In at least one embodiment, non-fencing border strip 406 are made of a similar material (except for conductive features) as conductive fencing strip 404. In at least one embodiment, a non-fencing border strip 406 may be provided to support non-playing aspects including for covering cords or wiring, and for supporting observers. In at least one embodiment, a non-fencing border strip 406 is provided at an edge of a structure block 408 forming a structure 402 with other structure blocks. In at least one embodiment, a structure block having a non-fencing border strip 406 may not be rotated for use in a different direction. In at least one embodiment, a structure 402 for sport fencing is within a floor cavity of a provided floor 420. In at least one embodiment, a structure 402 for sport fencing is over a provided floor 420.

In at least one embodiment, some part of individual structure blocks may be interfaced or mated together using interlock features illustrated in a callout 422 provided in FIG. 4A. In at least one embodiment, a callout 422 illustrates a side interlocking view of two structure blocks. In at least one embodiment, tongue-and-grove arrangements 428 may be provided between any layer 424; 426 of individual structure blocks having such an arrangement to keep the structure blocks in place. In at least one embodiment, such an arrangement may be in an alternate to interlocking offered in a cell-support layer. In at least one embodiment, tongue-and-grove arrangements 428 may be provided in upper layers between individual structure blocks. In at least one embodiment, when tongue-and-grove arrangements 428 are provided and are interlocked, upper layers of individual structure blocks sit flush with each other.

In at least one embodiment, game markings 412, for a fencing bout, may be pre-drawn on provided structure blocks 408, or may be drawn and redrawn for every type of fencing bout depending on any requirements. In at least one embodiment, there are no gaps when structure blocks 408 are brought together to form a structure 402. In at least one embodiment, individual structure blocks 408 include both non-fencing border strips 406 and fencing strips 404, but may also be provided with only fencing strips 404. In at least one embodiment, non-fencing border strips 406 cover channels provided for wiring or cords 410. In at least one embodiment, such wiring or cords 410 extend from a structure 402 and are associated with a receiver device, a monitor device, and a monitor. In at least one embodiment, a monitor may be a scoring display 418. In at least one embodiment, electrical couplers 414, 416 may be used between any of provided wiring or cords.

Figure 4B:
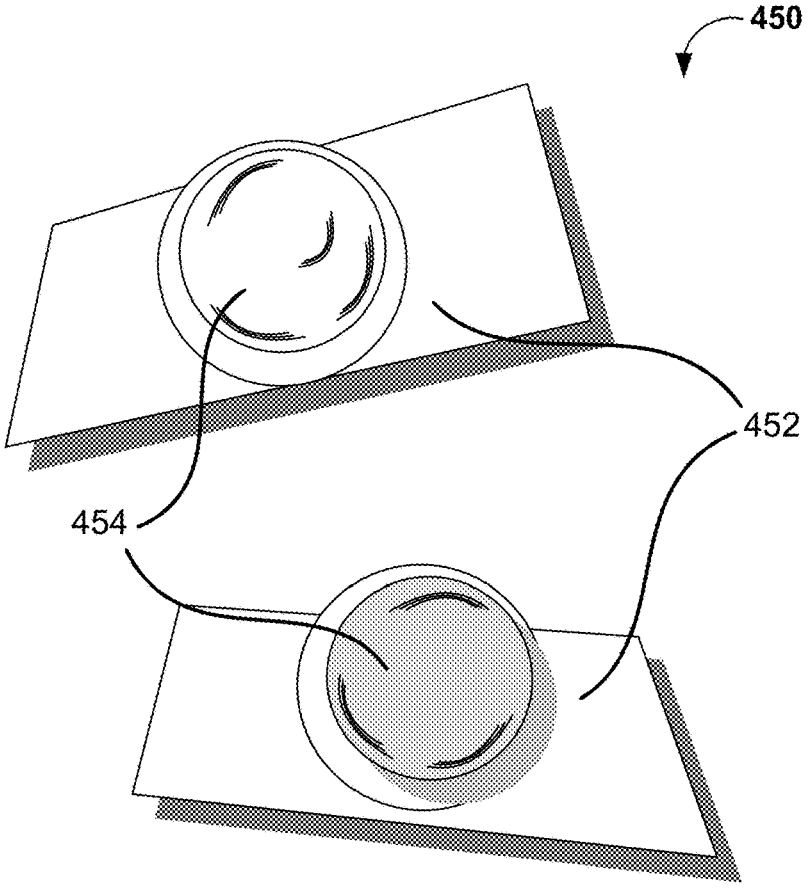
FIGS. 4B and 4C illustrate aspects of a shock absorber layer for structures used in sport fencing, according to at least one embodiment.
Figure 4C:
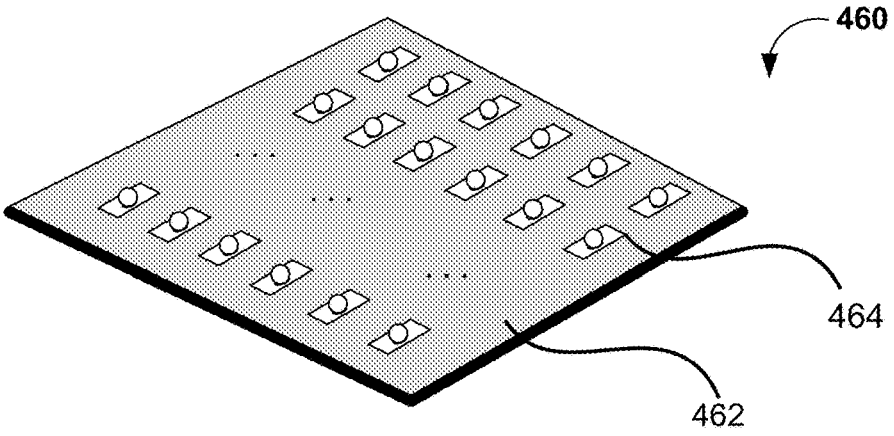

In at least one embodiment, aspects 450, 460 of a shock absorber layer used in sport fencing as illustrated in FIGS. 4A, 4B, may be used as described herein. In at least one embodiment, an aspect 450 of a shock absorber layer include rubber, plastic, or metal discs 452 having thereon rubber bumpers 454. In at least one embodiment, rubber discs 452 may be of any appropriate shape. In at least one embodiment, rubber discs having rubber bumpers 464 may be associated with a material layer 462 of supportive material, including wood or plastic. In at least one embodiment, rubber discs having rubber bumpers 464 may be patterned in a symmetrical or asymmetrical manner over a provided layer 462 so that maximum shock absorption features may be realized.

In at least one embodiment, computer and network aspects 500 used in sport fencing as illustrated in FIG. 5, may be used as described herein. In at least one embodiment, these computer and network aspects 500 may include a distributed system. In at least one embodiment, a distributed system 500 may include one or more computing devices 512-516. In at least one embodiment, one or more computing devices 512-516 may be adapted to execute and function with a client application, such as with browsers or a standalone application, and are adapted to execute and function over one or more network(s) 506.

In at least one embodiment, a server 504, having components 506A-X may be communicatively coupled with computing devices 512-516 via network 506 and via a receiver device 510, if provided. In at least one embodiment, components 506A-X include processors, memory and random access memory (RAM). In at least one embodiment, server 504 may be adapted to operate services or applications to manage functions and sessions associated with database access 502 and associated with computing devices 512-516. In at least one embodiment, server 504 may be associated with a receiver device and a monitor device. In at least one embodiment, server 504 may be at a venue for sport fencing, but may also be at a distinct location from a venue for sport fencing. In at least one embodiment, a monitor device and/or a receiver device is adapted to transmit, either through wires or wireless, information received therein, including touches, no-touches, and faults. In at least one embodiment, resistance and voltage changes may be received in a receiver device and transmitted to a monitor device that infers from changes in electrical properties based in part on instructions stored therein. In at least one embodiment, a server 504 may function as a monitor device but may also perform other functions. In at least one embodiment, one or more component 506A-X may be adapted to function as a monitor device within a server 504. In at least one embodiment, one or more components 506A-X may include one or more processors and one or more memory devices adapted to function as a monitor device, while other processors and memory devices in server 504 may perform other functions.

In at least one embodiment, server 504 may also provide services or applications that are software-based in a virtual or a physical environment. In at least one embodiment, when server 504 is a virtual environment, then components 506A-X are software components that may be implemented on a cloud. In at least one embodiment, this feature allows remote operation of receiver devices, monitor devices, and lights discussed in FIGS. 1-4C. In at least one embodiment, this feature also allows for remote access to scoring and to change information received and communicated between any of aforementioned devices. In at least one embodiment, one or more components 506A-X of a server 504 may be implemented in hardware or firmware, other than a software implementation described throughout herein. In at least one embodiment, combinations thereof may also be used.

In at least one embodiment, one computing device 516 may be a smart monitor or a display having at least a microcontroller and memory having instructions to enable display of information monitored by a monitor device and received by a receiver device. In at least one embodiment, one computing device 512 may be a transmitter device to transmit directly to a receiver device 510 or to transmit via a network 506 to a receiver device 510 and to a server 504, as well as to other computing devices 514. In at least one embodiment, other computing devices 514 may include portable handheld devices that are not limited to smartphones, cellular telephones, tablet computers, personal digital assistants (PDAs), and wearable devices (head mounted displays, watches, etc.). In at least one embodiment, other computing devices 514 may operate one or more operating systems including Microsoft Windows Mobile®, Windows® (of any generation), and/or a variety of mobile operating systems such as iOS®, Windows Phone®, Android®, BlackBerry®, Palm OS®, and/or variations thereof. In at least one embodiment, measurement of voltage, of resistance, and of current across one or more electrical paths is enabled and monitored by a monitor device having built-in meters. In at least one embodiment, values from such measurements are transformed to digital data to enable recording and transmission across different media, with or without network 506.

In at least one embodiment, other computing devices 514 may support applications designed as internet-related applications, electronic mail (email), short or multimedia message service (SMS or MMS) applications, and may use other communication protocols. In at least one embodiment, other computing devices 514 may also include general purpose personal computers and/or laptop computers running such operating systems as Microsoft Windows®, Apple Macintosh®, and/or Linux®. In at least one embodiment, other computing devices 514 may be workstations running UNIX® or UNIX-like operating systems or other GNU/Linux operating systems, such as Google Chrome OS®. In at least one embodiment, thin-client devices, including gaming systems (Microsoft Xbox®) may be used as other computing device 514.

In at least one embodiment, network(s) 506 may be any type of network that can support data communications using various protocols, including TCP/IP (transmission control protocol/Internet protocol), SNA (systems network architecture), IPX (Internet packet exchange), AppleTalk®, and/or variations thereof. In at least one embodiment, network(s) 506 may be a networks that is based on Ethernet, Token-Ring, a wide-area network, Internet, a virtual network, a virtual private network (VPN), a local area network (LAN), an intranet, an extranet, a public switched telephone network (PSTN), an infra-red network, a wireless network (such as that operating with guidelines from an institution like the Institute of Electrical and Electronics (IEEE) 802.11 suite of protocols, Bluetooth®, and/or any other wireless protocol), and/or any combination of these and/or other networks.

In at least one embodiment, a server 504 runs a suitable operating system, including any of operating systems described throughout herein. In at least one embodiment, server 504 may also run some server applications, including HTTP (hypertext transport protocol) servers, FTP (file transfer protocol) servers, CGI (common gateway interface) servers, JAVA® servers, database servers, and/or variations thereof. In at least one embodiment, a database 502 is supported by database server feature of a server 504 provided with front-end capabilities. In at least one embodiment, such database server features include those available from Oracle®, Microsoft®, Sybase®, IBM® (International Business Machines), and/or variations thereof.

In at least one embodiment, a server 504 is able to provide feeds and/or real-time updates for social media, such as for Twitter®, Instagram®, and Facebook®. In at least one embodiment, a server 504 is part of multiple server boxes spread over an area, but functioning for a presently described process in sport fencing. In at least one embodiment, server 504 includes applications to measure network performance by network monitoring and traffic management. In at least one embodiment, a provided database 502 enables information storage from fencing bouts and from online views or interactions, including user interactions, usage patterns information, adaptation rules information, and other information.

Figure 6:
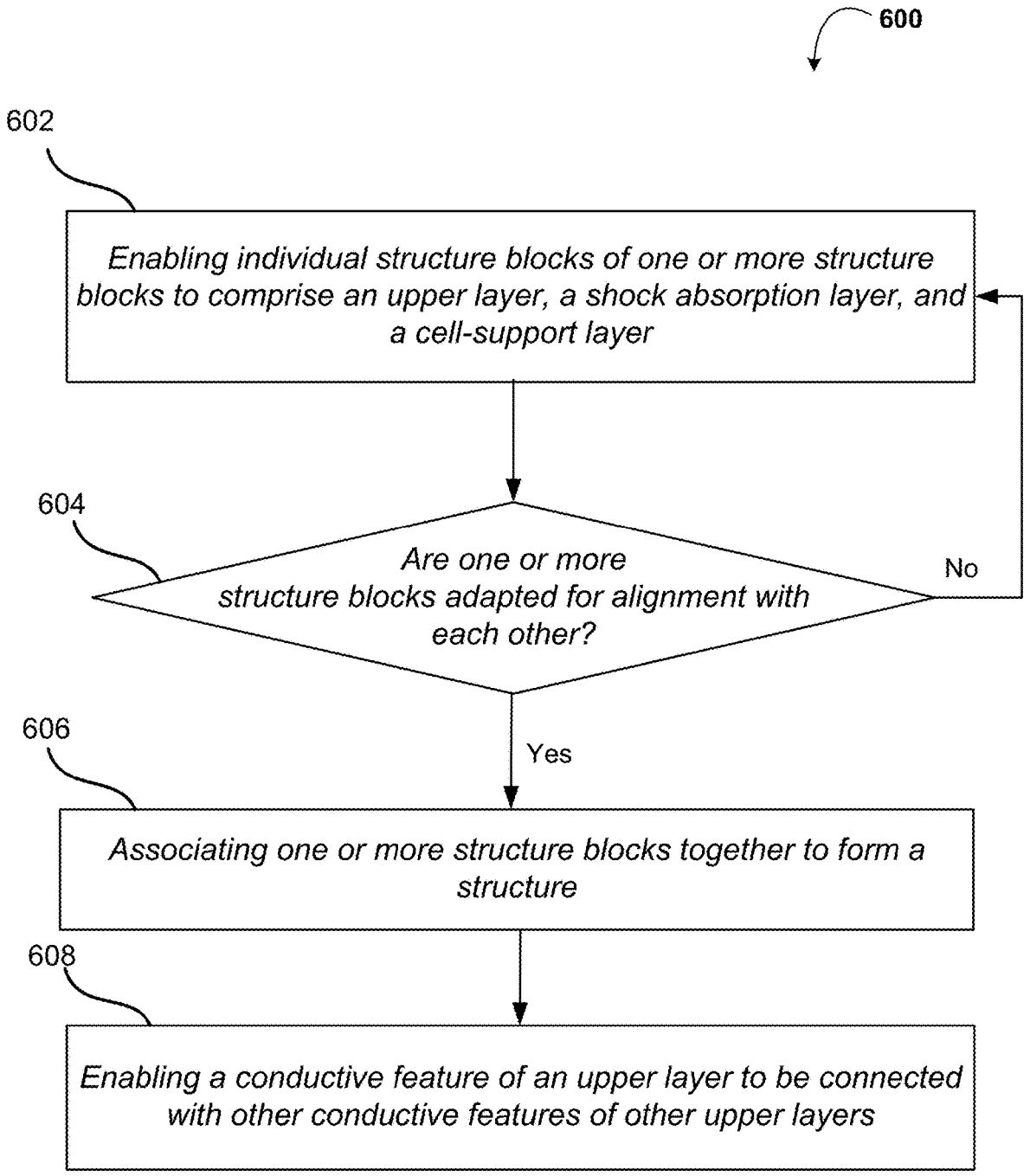
FIG. 6 illustrates a method associated with making or using structures used in sport fencing of FIGS. 2-5, according to at least one embodiment.

In at least one embodiment, a method 600 used in sport fencing as illustrated in FIG. 6, may be used as described herein. In at least one embodiment, a method 600 used in sport fencing is either used in manufacturing or in working of a structure having structure blocks for sport fencing. In at least one embodiment, method 600 includes a step 602 for enabling individual structure blocks of two or more structure blocks to include an upper layer, a shock absorption layer, and a cell-support layer. In at least one embodiment, step 602 may be performed at a venue or at a time of manufacture of a structure block. In at least one embodiment, step 602 performed at a venue may enable removal of only structure blocks having layers therein, for use at a different venue without recreating any layer therein. In at least one embodiment, an upper layer has a conductive feature and a friction feature. In at least one embodiment, a determination may be made via step 604 for verifying if structure blocks in step 602 are adapted for alignment with each other. In at least one embodiment, this may be by arranging structure blocks by width or length based in part on a determined width of a fencing stripe. In at least one embodiment, a step 606 is provided for associating the two or more structure blocks together to form a structure for sport fencing. In at least one embodiment, step 606 may be enabled by latching together structure blocks or at least placing guides into mating portions for each structure block. In at least one embodiment, structure blocks may be further enabled via step 602 if required.

In at least one embodiment, a step 608 provides a feature of enabling conductive feature to be connected with other conductive features of other structure blocks when two or more structure blocks are associated together. In at least one embodiment, step 608 may be enabled by coupling together electrical couplers of two or more structure blocks, and may further be enabled by coupling together electrical couplers of final structure blocks on ends of a formed structure with a receiver device, a monitor device, and a display. In at least one embodiment, a receiver device, a monitor device, and a display may be an integrated device or different devices.

In at least one embodiment, method 600 may include a further step or sub-step for associating rubber features together to form an shock absorption layer. In at least one embodiment, method 600 may include a further step or sub-step for enabling elevated ridges to form a friction feature and for providing conductive material to form a conductive feature of an upper layer. In at least one embodiment, method 600 may include a further step or sub-step for forming elevated ridges on or integrated with a conductive material.

In at least one embodiment, method 600 may include a further step or sub-step for locating reels or a wire storage having conductive wire on one or more ends of two or more structure blocks. In at least one embodiment, method 600 may include a further step or sub-step for enabling conductive wire to be electrically coupled to provide conduction between conductive feature of one structure block and other conductive features of other structure blocks.

In at least one embodiment, method 600 may include a further step or sub-step for enabling an anti-slipping material to form at least a portion of an underlayer that is under a cell-support layer. In at least one embodiment, an anti-slipping material prevents movement of a structure having structure blocks for sport fencing, and protects a floor under such a structure. In at least one embodiment, method 600 may include a further step or sub-step for enabling translucent plastic impregnated with conductive threads or filaments to form at least a portion of a conductive feature or to form an upper layer of structure blocks for sport fencing.

In at least one embodiment, method 600 may include a further step or sub-step for enabling a translucent plastic to have surface irregularities that form at least a portion of a friction feature. In at least one embodiment, method 600 may include a further step or sub-step for allowing illumination by one or more signals from an external device transmitted to lights under or within a translucent plastic. In at least one embodiment, one or more signals may be provided through the conductive threads or filaments between an external device, such as a wired or wireless computing device and lights there under or there within a translucent plastic. In at least one embodiment, method 600 may include a further step or sub-step for associating together rigid hollow cells in a honeycomb formation or a corrugated formation to form a cell-support layer.

While techniques herein may be subject to modifications and alternative constructions, these variations are within spirit of present disclosure. As such, certain illustrated embodiments are shown in drawings and have been described above in detail, but these are not limiting disclosure to specific form or forms disclosed; and instead, cover all modifications, alternative constructions, and equivalents falling within spirit and scope of disclosure, as defined in appended claims.

Terms such as a, an, the, and similar referents, in context of describing disclosed embodiments (especially in context of following claims), are understood to cover both singular and plural, unless otherwise indicated herein or clearly contradicted by context, and not as a definition of a term. Including, having, including, and containing are understood to be open-ended terms (meaning a phrase such as, including, but not limited to) unless otherwise noted. Connected, when unmodified and referring to physical connections, may be understood as partly or wholly contained within, attached to, or joined together, even if there is something intervening.

Recitation of ranges of values herein are merely intended to serve as a shorthand method of referring individually to each separate value falling within range, unless otherwise indicated herein and each separate value is incorporated into specification as if it were individually recited herein. In at least one embodiment, use of a term, such as a set (for a set of items) or subset unless otherwise noted or contradicted by context, is understood to be nonempty collection including one or more members. Further, unless otherwise noted or contradicted by context, term subset of a corresponding set does not necessarily denote a proper subset of corresponding set, but subset and corresponding set may be equal.

Conjunctive language, such as phrases of form, at least one of A, B, and C, or at least one of A, B and C, unless specifically stated otherwise or otherwise clearly contradicted by context, is otherwise understood with context as used in general to present that an item, term, etc., may be either A or B or C, or any nonempty subset of set of A and B and C. In at least one embodiment of a set having three members, conjunctive phrases, such as at least one of A, B, and C and at least one of A, B and C refer to any of following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, terms such as plurality, indicates a state of being plural (such as, a plurality of items indicates multiple items). In at least one embodiment, a number of items in a plurality is at least two, but can be more when so indicated either explicitly or by context. Further, unless stated otherwise or otherwise clear from context, phrases such as based on means based at least in part on and not based solely on.

Operations of method 600 or sub-steps described herein can be performed in any suitable order unless otherwise indicated herein or otherwise clearly contradicted by context. In at least one embodiment, a method 600 includes processes such as those processes described herein (or variations and/or combinations thereof) that may be performed under control of one or more computer systems configured with executable instructions and that may be implemented as code (e.g., executable instructions, one or more computer programs or one or more applications) executing collectively or exclusively on one or more processors, by hardware or combinations thereof.

In at least one embodiment, such code may be stored on a computer-readable storage medium. In at least one embodiment, such code may be a computer program having instructions executable by one or more processors. In at least one embodiment, a computer-readable storage medium is a non-transitory computer-readable storage medium that excludes transitory signals (such as a propagating transient electric or electromagnetic transmission) but includes non-transitory data storage circuitry (such as buffers, cache, and queues) within transceivers of transitory signals. In at least one embodiment, code (such as executable code or source code) is stored on a set of one or more non-transitory computer-readable storage media having stored thereon executable instructions (or other memory to store executable instructions) that, when executed (such as a result of being executed) by one or more processors of a computer system, cause computer system to perform operations described herein.

In at least one embodiment, a set of non-transitory computer-readable storage media includes multiple non-transitory computer-readable storage media and one or more of individual non-transitory storage media of multiple non-transitory computer-readable storage media lack all of code while multiple non-transitory computer-readable storage media collectively store all of code. In at least one embodiment, executable instructions are executed such that different instructions are executed by different processors—in at least one embodiment, a non-transitory computer-readable storage medium store instructions and a main central processing unit (CPU) executes some of instructions while other processing units execute other instructions. In at least one embodiment, different components of a computer system have separate processors and different processors execute different subsets of instructions.

In at least one embodiment, computer systems are configured to implement one or more services that singly or collectively perform operations of processes described herein and such computer systems are configured with applicable hardware and/or software that enable performance of operations. In at least one embodiment, a computer system that implements at least one embodiment of present disclosure is a single device or is a distributed computer system having multiple devices that operate differently such that distributed computer system performs operations described herein and such that a single device does not perform all operations.

Use of any and all of the at least one embodiments, or exemplary language (including such as) provided herein, is intended merely to better illustrate embodiments of disclosure and does not pose a limitation on scope of disclosure unless otherwise claimed. No language in specification should be construed as indicating any non-claimed element as essential to practice of disclosure.

All references, including publications, patent applications, and patents, cited herein are hereby incorporated by reference to same extent as if each reference were individually and specifically indicated to be incorporated by reference and were set forth in its entirety herein.

In description and claims, terms such as coupled and connected, along with their derivatives, may be used. It should be understood that these terms may be not intended as synonyms for each other. Rather, in ones of at least one embodiments, connected or coupled may be used to indicate that two or more elements are in direct or indirect physical or electrical contact with each other. Coupled may also mean that two or more elements are not in direct contact with each other, but yet still co-operate or interact with each other, unless otherwise stated.

Unless specifically stated otherwise, it may be appreciated that throughout specification terms such as processing, computing, calculating, determining, or the like, refer to action and/or processes of a computer or computing system, or similar electronic computing device, that manipulate and/or transform data represented as physical, such as electronic, quantities within computing system's registers and/or memories into other data similarly represented as physical quantities within computing system's memories, registers or other such information storage, transmission or display devices.

In a similar manner, a term such as a processor may refer to any device or portion of a device that processes electronic data from registers and/or memory and transform that electronic data into other electronic data that may be stored in registers and/or memory. As non-limiting ones of the at least one embodiments, a processor may be a CPU or a GPU. A computing platform may include one or more processors. As used herein, software processes may include, in at least one embodiment, software and/or hardware entities that perform work over time, such as tasks, threads, and intelligent agents. Also, each process may refer to multiple processes, for carrying out instructions in sequence or in parallel, continuously or intermittently. Terms such as a system and method are used herein interchangeably insofar as system may embody one or more methods and methods may be considered a system.

References herein may be made to method or process steps for obtaining, acquiring, receiving, or inputting analog or digital data into a subsystem, computer system, or computer-implemented machine. In at least one embodiment, such method or process steps may be accomplished in a variety of ways such as by receiving data as a parameter of a function call or a call to an application programming interface. In some implementations, such method or process steps may be accomplished by transferring data via a serial or parallel interface. In at least one embodiment, such method or processes may be accomplished by transferring data via a computer network from providing entity to acquiring entity. In at least one embodiment, methods or processes here may be accomplished by transferring data as an input or output parameter of a function call, a parameter of an application programming interface or inter-process communications.

In at least one embodiment, even though the above discussion provides at least one embodiment having implementations of described techniques, other architectures may be used to implement described functionality, and are intended to be within scope of this disclosure. In addition, although specific responsibilities may be distributed to components and processes, they are defined above for purposes of discussion, and various functions and responsibilities might be distributed and divided in different ways, depending on circumstances.

In at least one embodiment, although subject matter has been described in language specific to structures and/or methods or processes, it is to be understood that subject matter claimed in appended claims is not limited to specific structures or methods described. Instead, specific structures or methods are disclosed as example forms of how a claim may be implemented.

What is claimed is:

1. A structure for use in a sport fencing, comprising:

two or more structure blocks to be associated together to form a structure for sport fencing, individual structure blocks of the two or more structure blocks to comprise an upper layer, a shock absorption layer that is below the upper layer, and a cell-support layer that is below the shock absorption layer, the upper layer having a conductive feature and a friction feature, the conductive feature to be connected with other conductive features of other structure blocks upon the two or more structure blocks being associated together, wherein the shock absorption layer is comprised of separate shock absorbing components that are individually associated to the upper layer and to the cell-support layer.

2. The system of claim 1, further comprising:

one or more of the rubber, plastic, or metal features being the separate shock absorbing components that are associated together to form the shock absorption layer.

3. The system of claim 1, further comprising:

elevated ridges or surface irregularities to form the friction features; and conductive material to form the conductive feature.

4. The system of claim 3, further comprising:

the elevated ridges or surface irregularities formed on or integrated with the conductive material.

5. The system of claim 1, further comprising:

reels or a wire storage comprising conductive wire located on one or more ends of the two or more structure blocks, the conductive wire to be electrically coupled to provide conduction between the conductive feature and the other conductive features.

6. The system of claim 1, further comprising:

an anti-slipping material to form at least a portion of an underlayer that is below the cell-support layer, the anti-slipping material to prevent movement of the structure and to protect a floor under the structure.

7. The system of claim 1, further comprising:

translucent or transparent plastic or glass impregnated with conductive threads or filaments to form at least a portion of the conductive feature or to form the upper layer.

8. The system of claim 7, further comprising:

the translucent or transparent plastic or glass comprising surface irregularities to form at least a portion of the friction feature.

9. The system of claim 7, further comprising:

the translucent or transparent plastic or glass comprising lights there under or there within, the lights to allow illumination by one or more signals from a computing device, the one or more signals to be provided through the conductive threads or filaments between the computing device and the lights.

10. The system of claim 1, further comprising:

rigid hollow cells in a honeycomb or a corrugated formation to be associated together to form the cell-support layer.

11. A method to be used in a sport fencing, comprising:

enabling individual structure blocks of two or more structure blocks to comprise an upper layer, a shock absorption layer that is below the upper layer, and a cell-support layer that is below the shock absorption layer, the upper layer having a conductive feature and a friction feature, wherein the shock absorption layer is comprised of separate shock absorbing components that are individually associated to the upper layer and to the cell-support layer;

associating the two or more structure blocks together to form a structure for sport fencing; and enabling the conductive feature to be connected with other conductive features of other structure blocks upon the two or more structure blocks being associated together.

12. The method of claim 11, further comprising:

associating one or more of rubber, plastic, or metal features as the separate shock absorbing components together to form the shock absorption layer.

13. The method of claim 11, further comprising:

enabling elevated ridges or surface irregularities to form the friction feature; and providing conductive material to form the conductive feature.

14. The method of claim 13, further comprising:

forming the elevated ridges or surface irregularities on or integrated with the conductive material.

15. The method of claim 11, further comprising:

locating reels or a wire storage comprising conductive wire on one or more ends of the two or more structure blocks; and enabling the conductive wire to be electrically coupled to provide conduction between the conductive feature and the other conductive features.

16. The method of claim 11, further comprising:

enabling an anti-slipping material to form at least a portion of the underlayer that is under a cell-support layer, the anti-slipping material to prevent movement of the structure and to protect a floor under the structure.

17. The method of claim 11, further comprising:

enabling a translucent or transparent plastic or glass impregnated with conductive threads or filaments to form at least a portion of the conductive feature or to form the upper layer.

18. The method of claim 17, further comprising:

enabling the translucent or transparent plastic or glass to comprise surface irregularities that form at least a portion of the friction feature.

19. The method of claim 17, further comprising:

allowing illumination by one or more signals from a computing device to lights under or within the translucent or transparent plastic or glass, the one or more signals to be provided through the conductive threads or filaments between the computing device and the lights.

20. The method of claim 11, further comprising:
associating together rigid hollow cells in a honeycomb or a corrugated formation to form the cell-support layer.

* * * * *